US009428249B2

(12) United States Patent
Heimerl

(10) Patent No.: US 9,428,249 B2
(45) Date of Patent: Aug. 30, 2016

(54) MODULAR WATERCRAFT DEVICE

(71) Applicant: Robert Lee Heimerl, Sheboygan, WI (US)

(72) Inventor: Robert Lee Heimerl, Sheboygan, WI (US)

( * ) Notice: Subject to any disclaimer, the term of this patent is extended or adjusted under 35 U.S.C. 154(b) by 36 days.

(21) Appl. No.: 14/644,837

(22) Filed: Mar. 11, 2015

(65) Prior Publication Data

US 2015/0307158 A1 Oct. 29, 2015

Related U.S. Application Data

(60) Provisional application No. 61/985,090, filed on Apr. 28, 2014.

(51) Int. Cl.

| | |
|---|---|
| ***B63B 35/00*** | (2006.01) |
| ***B63B 17/04*** | (2006.01) |
| ***B63B 3/08*** | (2006.01) |
| ***B63H 25/06*** | (2006.01) |
| ***B63H 1/14*** | (2006.01) |
| ***B63H 9/04*** | (2006.01) |
| ***B63B 1/12*** | (2006.01) |
| *B63H 25/02* | (2006.01) |
| *B63B 29/02* | (2006.01) |
| *B63B 29/04* | (2006.01) |

(52) U.S. Cl.

CPC ..... *B63B 3/08* (2013.01); *B63B 1/121* (2013.01); *B63B 35/00* (2013.01); *B63H 1/14* (2013.01); *B63H 9/04* (2013.01); *B63H 25/06* (2013.01); *B63B 17/04* (2013.01); *B63B 29/02* (2013.01); *B63B 2029/022* (2013.01); *B63B 2029/043* (2013.01); *B63B 2035/004* (2013.01); *B63H 2025/022* (2013.01)

(58) Field of Classification Search

CPC ..... B63B 3/08; B63B 17/04; B63B 35/00

USPC ..... 114/352

See application file for complete search history.

(56) References Cited

U.S. PATENT DOCUMENTS

| | | | | |
|---|---|---|---|---|
| 3,822,427 | A * | 7/1974 | Ewart, Jr. | B63B 7/04 114/352 |
| 4,052,761 | A * | 10/1977 | Rilling | B63B 7/04 114/352 |
| 4,366,769 | A * | 1/1983 | Lingeman | B63B 3/08 114/352 |
| 4,694,770 | A * | 9/1987 | Kitner | B63B 35/731 114/123 |
| 4,790,256 | A * | 12/1988 | Levine | B63B 7/04 114/352 |
| 4,827,865 | A * | 5/1989 | Yelderman | B63B 7/04 114/353 |
| 4,829,926 | A * | 5/1989 | Voelkel | B63B 1/121 114/352 |
| 5,261,346 | A * | 11/1993 | Updyke | B63B 7/04 114/352 |
| 6,240,865 | B1 * | 6/2001 | Hubbard | B63B 1/125 114/39.28 |
| 6,325,013 | B1 * | 12/2001 | Brown | B63B 7/04 114/352 |

(Continued)

*Primary Examiner* — S. Joseph Morano
*Assistant Examiner* — Jovon Hayes
(74) *Attorney, Agent, or Firm* — Mandy T. Garrels; Ceres Patent & Technology, LLC

(57) ABSTRACT

The invention herein pertains to a modular water craft device and system wherein a plurality of individual navigable watercraft devices interconnects at their hull and deck. Each individual watercraft unit comprises the following elements: a deck, a hull with three or more sides, a steering wheel, and rudder. Each individual watercraft device detachably interconnects with another at their deck and hull at a common side. The interconnection creates a greater unitary deck and stable hull connection. Each modularized watercraft is defined as two or more individual water craft devices detachably interconnected between their sides to form a greater stable modular platform and unitary hull and deck system. The modularized watercraft device may convert between navigational and non-navigational roles.

10 Claims, 6 Drawing Sheets

(56) References Cited

U.S. PATENT DOCUMENTS

| | | | | |
|---|---|---|---|---|
| 6,325,014 | B1 * | 12/2001 | Blanchard | B63B 7/04 114/352 |
| 6,619,224 | B1 * | 9/2003 | Syfritt | B63B 1/04 114/284 |
| 6,637,362 | B1 * | 10/2003 | Avidiya | B63B 7/04 114/352 |
| 6,959,659 | B1 * | 11/2005 | Burrell | B63B 1/125 114/39.27 |
| 6,983,715 | B2 * | 1/2006 | Boudeau | B63B 7/082 114/345 |
| 7,395,773 | B1 * | 7/2008 | Finefield | B63B 7/04 114/352 |
| 7,721,671 | B2 * | 5/2010 | Ager | B63B 7/02 114/353 |
| 7,963,243 | B2 * | 6/2011 | Quigley | B63B 7/04 114/347 |
| 8,327,792 | B2 * | 12/2012 | Ohman | B63B 7/04 114/347 |
| 8,474,393 | B1 * | 7/2013 | Chandler | B63B 3/08 114/352 |
| 8,783,203 | B1 * | 7/2014 | Woods | B63B 7/04 114/352 |
| 9,150,295 | B2 * | 10/2015 | West | B63B 7/08 |
| 2010/0050922 | A1 * | 3/2010 | Quigley | B63B 7/04 114/352 |
| 2010/0058970 | A1 * | 3/2010 | McLean | B63B 7/04 114/352 |
| 2011/0146561 | A1 * | 6/2011 | McLean | B63B 7/04 114/352 |
| 2012/0006249 | A1 * | 1/2012 | Harder | B63B 7/04 114/352 |

* cited by examiner

MODULAR WATERCRAFT DEVICE

CROSS REFERENCE

This nonprovisional utility patent application claims benefit of and incorporates by reference in its entirety the prior filed provisional patent application, App. No. 61/985,090.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark office, patent file or records, but otherwise reserves all copyright rights whatsoever.

BACKGROUND OF THE INVENTION

1. Field of the Invention

The present matter relates to a water craft device, system and method of construction, in particular relating to a modular system for organizing and constructing passenger boats, platforms and related fixtures.

2. Background

Watercrafts such as among many, ships and boats, are utilitarian devices constructed for specific intended purposes. The design of any particular type of watercraft is distinguishable from another depending on the affect sought to be achieved. Water crafts, in general, are fine tuned devices that must meet the variable demands of the particular type of waterway it is made to manage. Since lives and property are carried over dangerous conditions, the bar for safety is set high. As such, every detail in material and construction of a watercraft device carries an equal level of importance and relevance to the overall effectiveness and safety of said device. In this art, safety is concerned not only with the presence of necessary matter, but also with the absence of unnecessary matter to achieve ergonomic efficiency.

Because water crafts in general are directly exposed to variable forces of nature in the most unavoidable ways (unlike ground vehicles that are able to quickly pull over to shelter in lieu of a storm) each piece of material constructing the device is consciously chosen for specific reason and purpose tailored to the conditions the device is intended to withstand. Unlike other types of utility devices, water craft construction and design leaves less room for substitution of material components outside of acceptable industry standards.

The general category of watercrafts may be divided further into navigable versus non-navigable devices. Typically, navigable watercrafts comprise a hull, a bow (the forward pointed front end of a ship meant to cut through water), one or more means to steer or navigate direction of the navigable water craft such as a sail, steering wheel, paddles, etc. Navigable watercrafts may include but is not limited to a ship, a boat, a kayak, etc. Contrast this with non-navigable watercrafts, which do not contain or partially lack means for steering or navigation. These would include but is not limited to drifting rafts or stationary floating platforms. The purpose of non-navigable watercrafts is usually to achieve the given effect, which may be to drift and float freely in order to capture the experience and sensation of a moving current. Similarly, a stationary floating platform designed to maintain position offshore may seek to create an artificial offshore barrier reef, a stationary carrier platform, or an artificial island. The current art does not provide cross-over devices that serve both navigable and non-navigable purposes.

It is further observed that current art in the industry of navigable watercraft devices comprise single or double hull devices. The overall shape of the hull, whether single or multiple, must enable effective navigation. As such, multiple hull watercrafts intended for navigation and transport typically involve no more than two hulls in parallel position with pointed bows as with a traditional catamaran and catamaran style pontoons. These said crafts share in common a single navigation unit comprising a single engine unit and a single steering unit. A multiple hull device wherein the hulls are positioned in non-parallel manner (i.e. at angles from each other) would render navigation, steering and transport impractical. For this reason, there is currently not a cross-over multiple hull water craft designed for both navigable and non-navigable purposes.

Modular watercraft systems are even less common in the industry. Within the category of navigable devices, the prior art discloses modular systems intended for either compactable storage or extension of length. In these cases, a single whole navigable device is constructed from separate modular components. The current art does not provide for modular connection of multiple individual watercrafts to create a larger device having cross over effect.

In the realm of watercraft devices, there remains an undiscovered area for crossover (navigable and non-navigable purpose and design) application. The ability to achieve crossover modular construction would further enable connection of not only multiple hulls but also multiple decks. The ability to modularize decks would further enable new ways to construct and design deck fixtures. The cross over effect would establish the first dual purpose watercraft device and related industries. Such application would have wide practical appeal within the industry, and especially recreational areas of watercraft and boating where greater popular use may occur.

In the area of recreational boating, popular boats such as pontoons, catamarans or sail boats are designed and purposed for navigation and transport. Naturally, when they are in anchored position, they are in a semi-stationary state but not completely so. Due to the shape and design of these devices for purpose of navigation, they tend to move and drift even when anchored and often do not interconnect with other boats without risk of damage upon contact. These boats serve recreational purposes and allow users to enter between the boat and water easily. Although users apply multiple purposes to these single purposed devices, the current art does not provide for a convertible feature that expands on the user's recreational interaction between the boat and the water. That is, the current art for navigable watercraft devices has not expanded beyond singular purposed design to a cross over design allowing navigable watercraft devices to convert or extend into non-navigable application. There is a need in the art for both cross over watercraft devices that allow users to maximally interact with the device and the environment in both navigable and non-navigable manner.

There is further a need for cross-over fixtures and furnishings that can be adaptable to the expanded and convertible application of crossover watercrafts. Few crossover watercraft fixtures and furnishings exist, specifically those serving both above and below water surface application. The crossover nature provided in this invention for navigable and non-navigable watercrafts create new areas of consideration that opens doors for redesigning traditional navigable or non-navigable furnishing to having crossover application.

BRIEF SUMMARY OF THE INVENTION

The invention herein pertains to a modular water craft device and system wherein a plurality of individual navigable watercraft devices interconnects at their hull and deck. The modularized watercraft device may convert between navigational and non-navigational roles. Each individual watercraft may convert between non-navigable to navigable roles by mechanical means such disabling mechanisms or by physical means such as embodying a style of interconnection or orientation that obstructs movement in water. The navigational system or unit of each individual watercraft device may comprise but would not be limited to any of the following combination: a steering wheel, a tiller, an engine motor, a propeller, a rudder, and a sail, all of which enables the watercraft to move and adjust position upon navigation. In navigable form, the modularized watercraft device would be moved in unified manner between its individual watercraft units either by a single navigation unit or multiple navigation units functioning in tandem. The maximum speed of movement should be low to minimize mishandling, injury and damage. In non-navigable form, the modularized device may function as a floating platform or free floating dock wherein every navigational unit is disabled or rendered nonfunctional. In this position, the disabled navigational units would require special code or key for enablement. Disabling means relating to the navigational unit of each individual watercraft unit may be achieved by manual, mechanical, electronic, pneumatic means. Modularization of individual watercraft devices according to this invention is not intended for high speed application. Mishandling of such a device contrary to the intended use may damage the components or injure passengers.

Each individual watercraft unit comprises the following elements: a deck, a hull with three or more sides, a steering wheel, and rudder. Additional elements may include an engine, motor and propeller. Each individual watercraft device detachably interconnects with another at their deck and hull at a common side. The interconnection creates a greater unitary deck and stable hull connection. Each modularized watercraft is defined as two or more individual water craft devices detachably interconnected between their sides to form a greater stable modular platform and unitary hull and deck system.

The interconnection between individual watercrafts may be achieved by a variety of means. A first means provides parallel facing male and female connector pieces between two individual watercraft units. The connector pieces may enable parallel side connection or perpendicular front/rear connection of hulls and platform. The point of connection is preferably between the deck and below the waterline of the hull, preferably below the deck along the hull. Other means of connection may be by a combination of rope, chain, latch or hook features. The tightness of connection would depend on the amount of tolerance sought to be achieved or minimized. Tolerance in this case refers to the amount of shift and movement allowed between the interconnected boats. This tolerance may be adjustable to enable adaptation to environmental conditions and manage frictional contact. The disclosed means for interconnection enables individual watercraft units to connect between their front and rear sides or their left and right sides, allowing the user freedom to create a variety of platform space or shapes. Additional reinforcement between hulls (or pontoons if dealing with gas filled hulls) may be necessary in larger modules.

This modular watercraft system creates a new industry in modular deck furnishing. Fixtures and furnishings may be strategically positioned on each individual watercraft unit to enable modularization of deck furnishing between interconnected watercraft units. While the plurality of platforms may interconnect to form a larger modular space, the fixtures and furnishings themselves need not connect. Furnishing and fixture may comprise the following: restroom facility, overhanging canopy (may be retractable), tables, bars, chairs, seating areas, walkway areas, storage areas, ladders and hanging devices, electronic shelving and platforms, second story decks and traffic or resting areas, etc. The intent is to enable coordination of larger habitable unobstructed space by modular preconfigured design. Each individual watercraft preferably contains a guard rail erected on all exposed sides adjacent to water's edge. The guard rail should be removable at the sides of interconnection to create continuity of space. To further facilitate continuity and tandem control, the steering wheel of each individual watercraft unit may be positioned at opposite sides (either far right or far left sides) of two interconnected individual watercraft devices such that the two watercraft units with oppositely positioned steering units may connect by a handle bar for tandem navigation. Tandem navigation in this case refers to unilateral steering of steering wheel and rudder among two or more interconnected watercraft units.

Switching between navigable and non-navigable form may be at the determination and choice of the user or via automatic means. The steering units (i.e. steering wheels and rutters) of each navigation unit must be aligned to allow tandem movement of the modularized watercraft. Upon interconnection each navigational unit may require disablement. At least one navigation unit may be left enabled to allow short distance movement and positional adjustment. Tandem navigation by one user may be achieved with additional interconnecting mechanisms for the plural steering units. The purpose of enabling navigation when the watercrafts are interconnected is to manage drift, adjust position, or for transport of the modularized watercraft between shore and offshore locations.

Optional furnishing and features for recreational use may comprise retractable awning and canopy, modular bar seating, second level deck seating and stairway, and convertible water submersed resting area. Said awning and canopy may serve dually as a gutter system, collecting and redirecting water away from the individual or modularized watercraft deck. Said modular bar seating area may comprise the shape of a half or quarter sized rounded or angular shaped bar and seating area. Strategic positioning to the far right or left side of the deck allows modularization of said furnishing between oppositely positioned interconnected decks.

The convertible water submersed resting area takes advantage of the cross-over feature of the watercraft, between navigable and nonnavigable status. As the watercraft is engaged in non-navigable status, preferably anchored and stationary, the convertible water submersed resting area comprises a seating and arm rest area hingedly connected to a deck at water's edge and lowered into the water enabling water submersed seating. When the watercraft is engaged in navigable form, the convertible water submersed resting area rotates upward at its hinge connection on the deck, converting to a raised position above deck for above deck seating and resting. Additional elements such as a cross bar may be attached to serve a tertiary benefit of a guard rail. Said hinge connection comprising any known mechanism or means for rotational pivoting and locking. Said convertible water submersed resting area may be attachable to any deck surface adjacent to the edge of a water body, such as a pool deck or a board walk, creating a convertible above water and below water bar seating environment. Said convertible water submersed resting area further having a telescoping option to allow extension and retraction for various height adjustment needs.

DETAILED DESCRIPTION OF THE INVENTION

Figure 4:
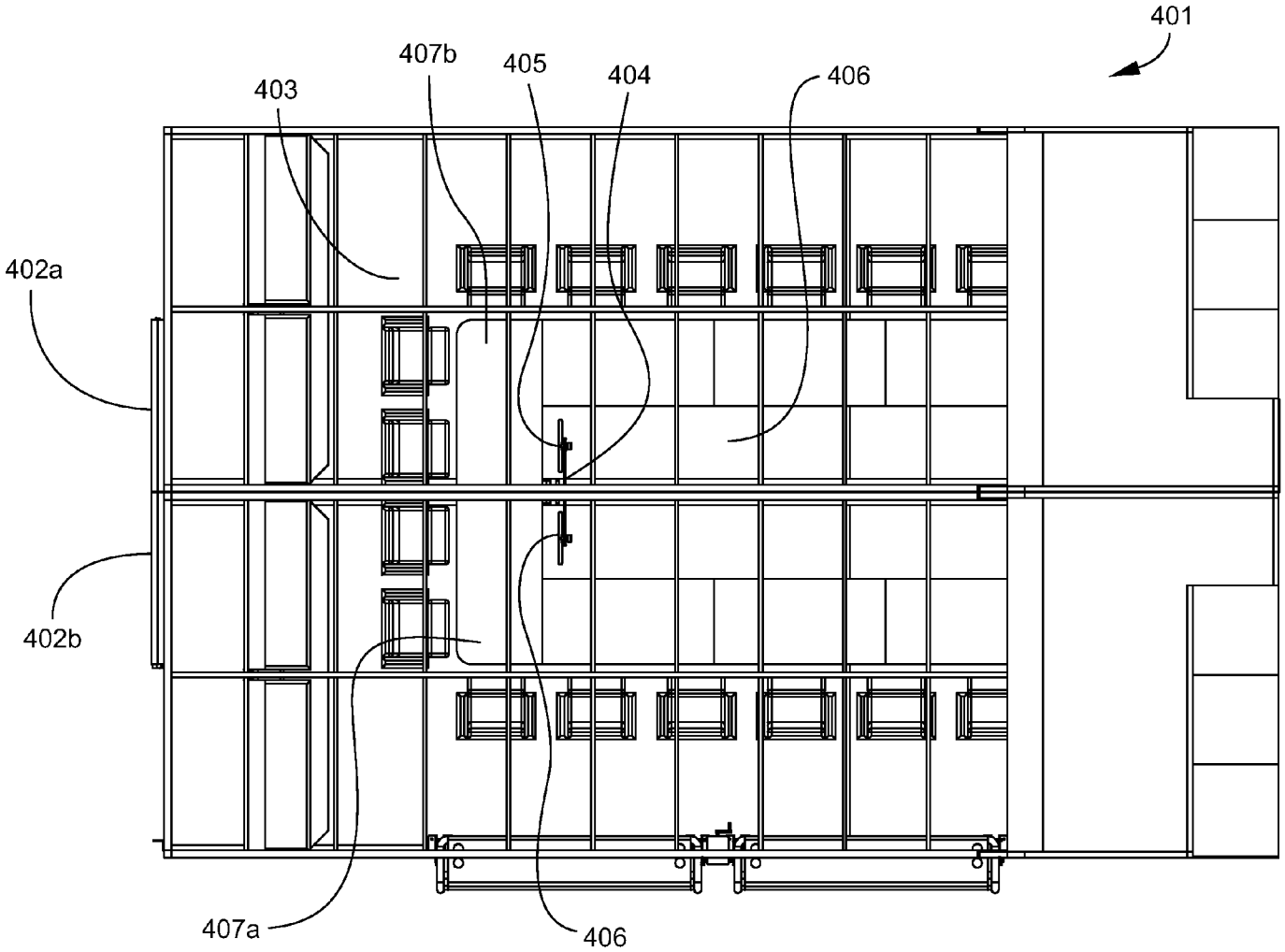
FIG. 4 is a top perspective view of a modular watercraft device according to one embodiment of this invention.
Figure 5:
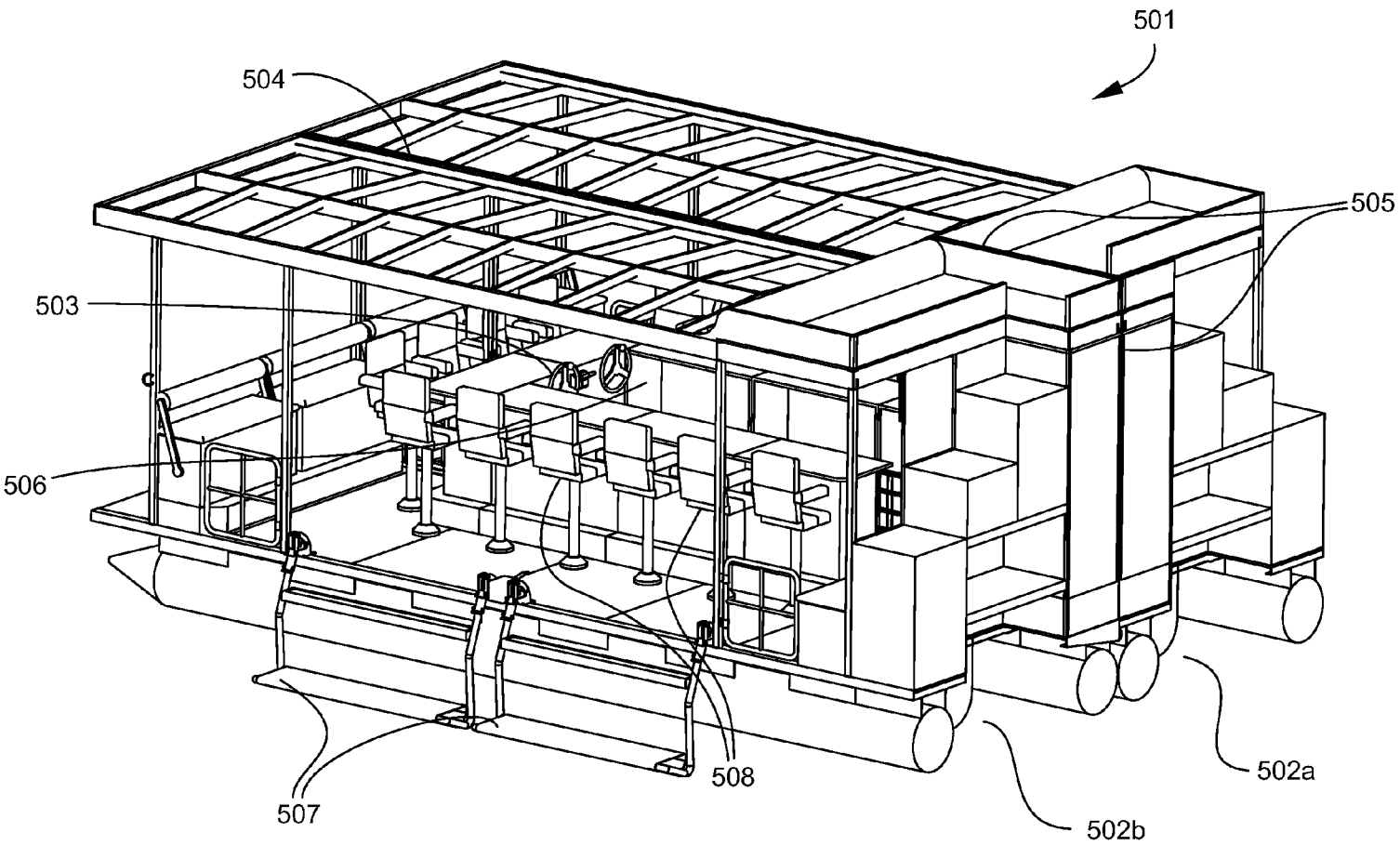
FIG. 5 is a side perspective view of a modular watercraft device according to one embodiment of this invention.
Figure 6:
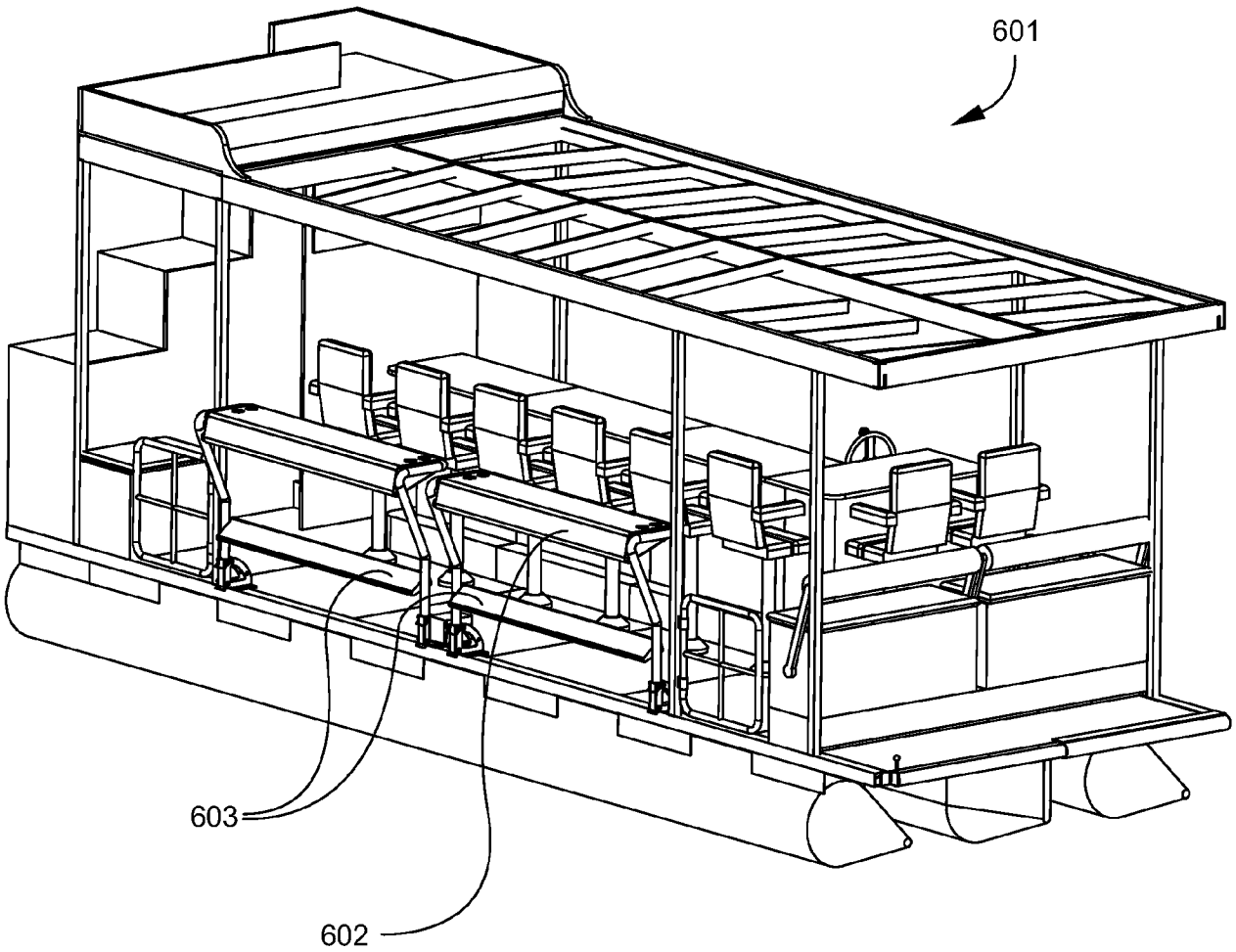
FIG. 6 is a side perspective view of a modular watercraft device according to one embodiment of this invention.

The invention herein pertains to a modular watercraft device 401. See FIG. 4. The invention further provides for modular fixtures adaptable to said modular watercraft device. See FIG. 5. The modular watercraft device 501 comprises a plurality of individual watercraft units 502*a, b* such as but not limited to catamarans or pontoon, boats or rafts. According to one embodiment of this invention, two or more individual watercraft units interconnecting at their sides 402*a, b*, 103, 104. Said interconnection is achieved by any known means along abutting sides of two individual watercraft units. According to one embodiment of this invention, said connection may be by male and female sliding tube mechanisms 102,103 that interlock in the interior. Alternatively, said interconnecting mechanism may comprise other known combination of means such as chain, rope, latch, hook, a sliding rib style zipper element, etc.

Figure 1:
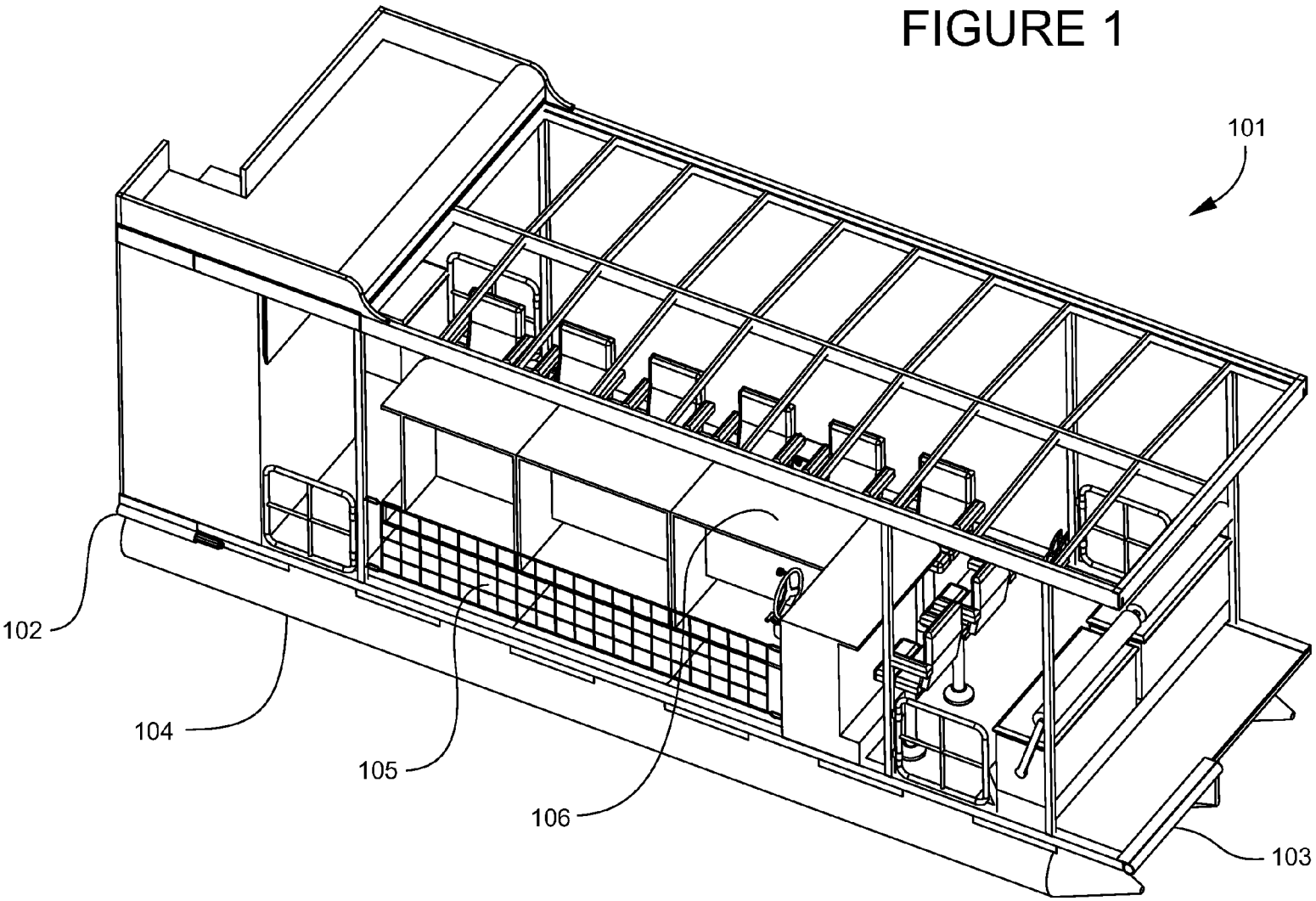
FIG. 1 is a side perspective view of an individual watercraft unit according to one embodiment of this invention.
Figure 2:
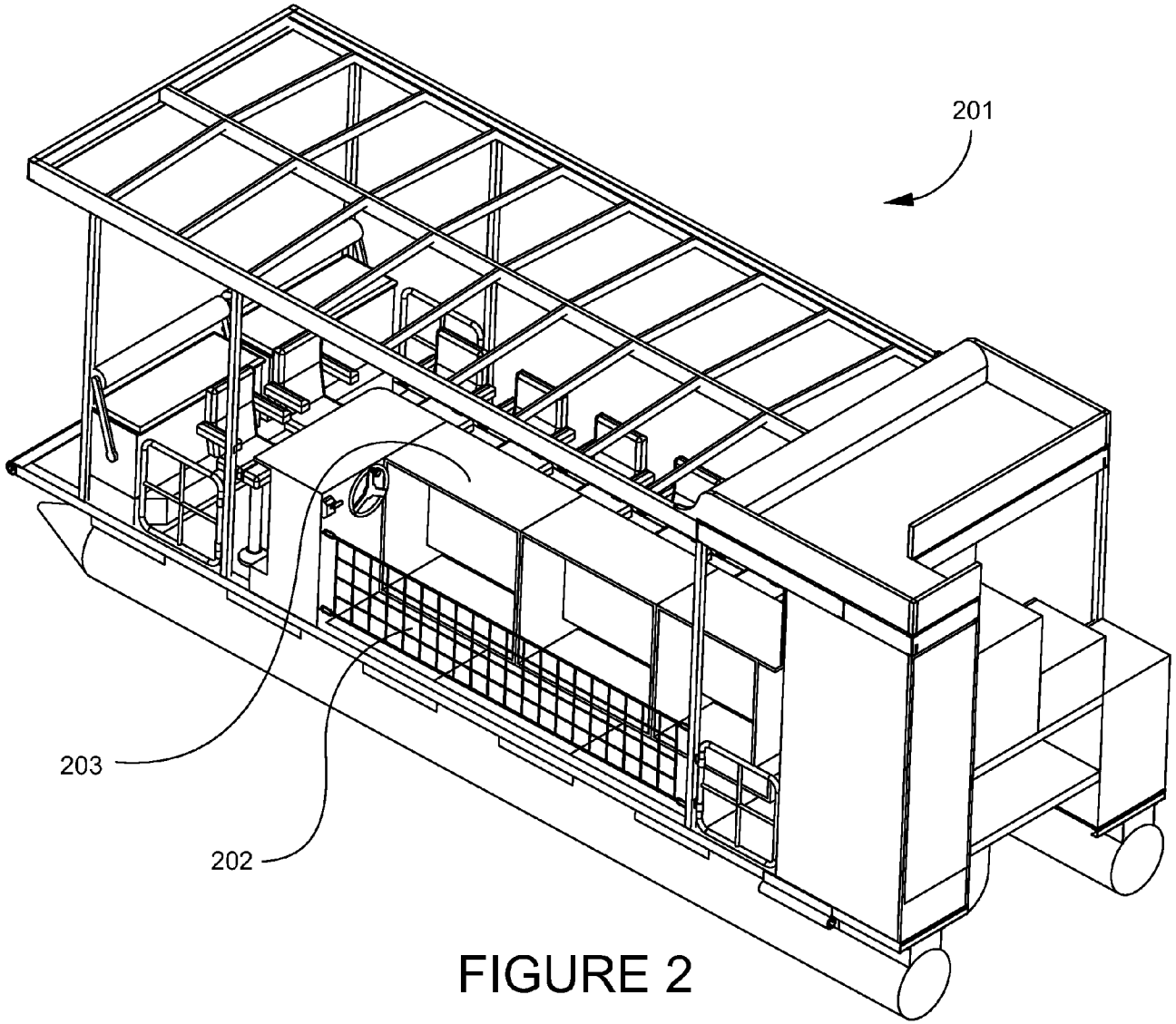
FIG. 2 is a side perspective view of an individual watercraft unit according to one embodiment of this invention.
Figure 3:
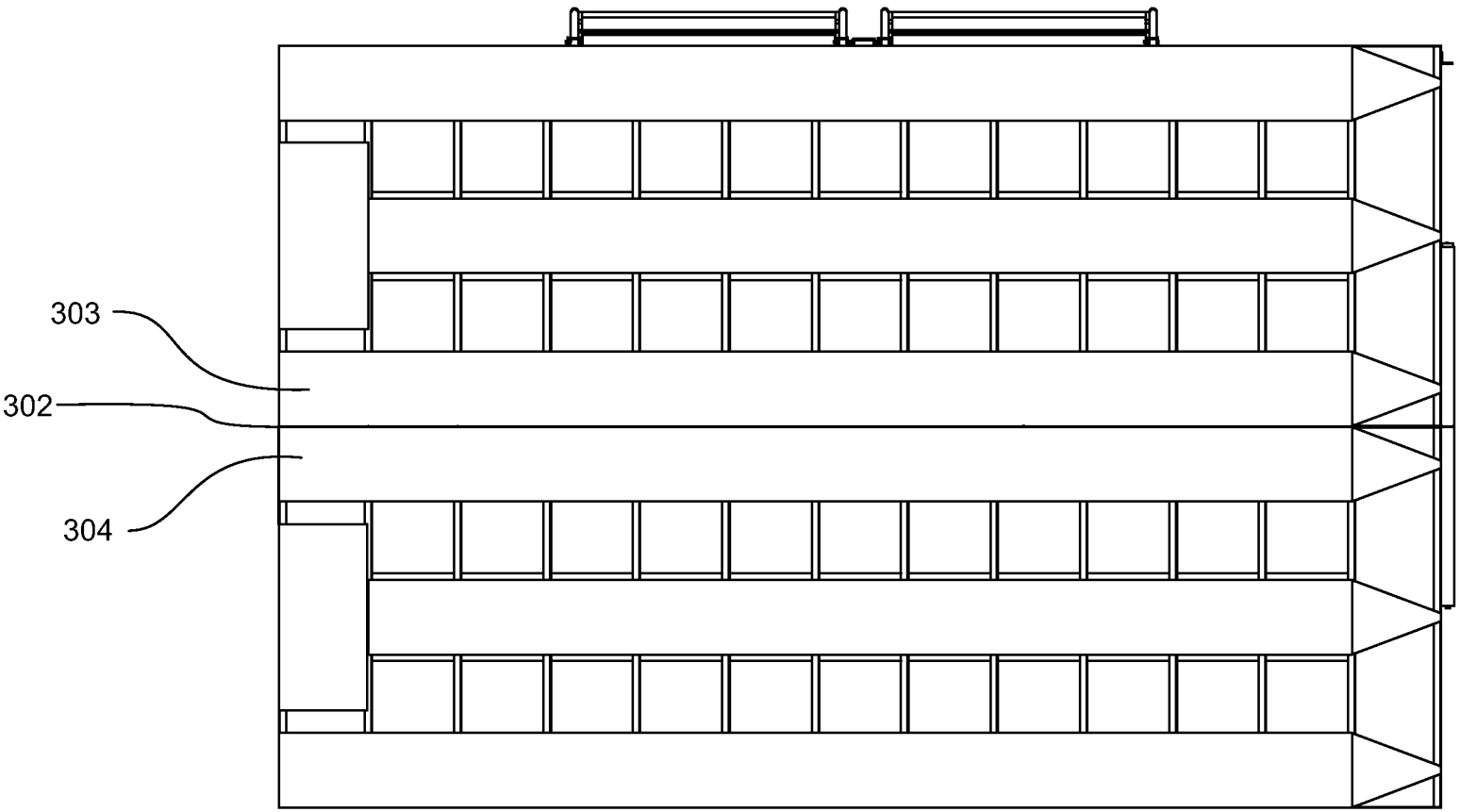
FIG. 3 is a bottom perspective view of a modular watercraft device according to one embodiment of this invention.

Each individual watercraft unit interconnects to form a larger modular watercraft device with a unitary deck platform 403. The interconnection may be between adjacent sides of two oppositely facing boats, preferably between their said hulls. 402 *a, b,* 302. The interconnecting component may have additional buffering element 104 positioned between hull and deck to minimize frictional damage. The larger device in modular form (having two or more interconnected individual watercraft units) may be navigable by maintaining at least one functioning navigation unit 503. A module may be converted to non-navigable status by disabling the navigation unit. Disablement may be by automatic or selective means. Tandem navigation 403 by a single user may be achieved by interconnecting 404 two abutting steering wheels 405, 406 of two oppositely facing individual watercraft units. In this manner, tandem steering 404, 503 would require a left 101 and a right 201 sided individual watercraft unit. FIGS. 1 and 2. Alternatively, tandem navigation may be achieved by electronic coordination between the interconnected navigational systems of the various boat units. According to this alternative embodiment, adjacent abutment of steering components would not be necessary for tandem coordination.

The modularized decks may comprise any variety of shape to fit the desired effect. More practical shapes comprise squares and rectangles, FIGS. 1 and 2, providing straight sides and right angles for easy fit and storage. Rounded or circular deck shapes may be appealable where the effect of having a plurality of connected islands is sought to be achieved. Individual watercraft units may be modularized with each other further attachable to a land locked surface such as a pier for nonnavigable expansion purposes. This has the dual affect of stabilizing and anchoring the modular watercraft. This cross over application allows the modular watercraft to gain access to landside resources such as electricity and potable water as well as reaching out to waterfront tourism establishments. In any case, a buffer is needed to buttress movement between connected hulls and or decks to create greater stability and to avoid damage from frictional movement. The buffer may comprise but is not limited to pontoons 104, 303, 304, or bridge platform between deck surfaces, etc. Rubberized air filled pontoons 303, 304 or solid semi-elastic material that flexes and cushion between the connected boats greatly absorbs frictional movement between abutting units. The buffering component may be built into the boat structure or be offered as a detachable portable element.

Material composition of the interconnecting mechanism 102, 103 is preferably durable, nonbrittle and noncorrosive to withstand heavy pressure, frictional force and long term water (salt and fresh) exposure. The interconnecting component may be built into the boat structure 102, 103 or be offered as a detachable portable element. Additional coupling may be available for above deck fixture interconnection between individual watercraft units such as between overhang awning 504 or roof elements 505.

When in connected modular form, the combined watercrafts form a larger platform 403. Preferably, the guard rails 202, 105 of the separate watercraft units are disengaged when in modular connected form to reveal an open wide deck space 403, 406, 506. For application in the recreational area of this industry, it is also preferable to allow the deck space to be furnished and rearrangable in modular manner. For example, deck fixtures and furnishings 507, 508 may be engaged and disengaged to fit the various size and style of the modularized platform. The space may be reinvented or redesigned to fit the particular aesthetic and recreational purpose by simple connectable fixtures and furnishing components. In one instance, two watercrafts may be combined to create a larger space wherein the center of the enlarged modularized platform having an interconnected bar area 407 *a, b* for purposes of serving business meetings or catering events. Alternatively, should the two boats separate and disengage, each half of the bar area 203, 106 may be disconnected from each other to form opposite halves of the whole bar strategically positioned on each respective boat unit. This style of design would require a left sided and right sided boat. FIGS. 1 and 2. Alternatively, the bar area may be disconnectable and attachable at choice locations on the deck such that a single style boat deck may be manufactured that may accommodate a wide variety of design preferences. In this case, the deck would comprise strategically placed connection points or hidden receivers throughout its floor surface to allow changeable staging of fixtures. Deck fixtures may have specialized features such as multi-purpose convertibility for the purposes of this invention, focusing on cross-over navigational and nonnavigational recreational use. For example, a convertible water submersed seating area 507 and guard rail device unit. Said convertible water submersed seating area providing a resting area for the user under water in lowered position 507 and as above deck resting area 602 and guard rail 603 in upward raised position. Said device converts by a hinged pivot locking mechanism. Essentially, it is yet another preferred embodiment of this invention that the boat decks contain strategically located deck surface receivers that allow adaptable furnishing for various styles of modular or singular platform embodiments. Current art in the industry provide only fixture means and receivers intended for single deck furnishing arrangement and not multi-deck modular staging.

Said convertible water submersed resting area 507 is composed of several elements. Said elements comprising at least one or more horizontal flat platforms 603, 602 interconnected to two or more vertically positioned bars. Said horizontal platforms 603, 602 positioned parallel to each other consecutively wherein a first lower 602 is rearward from a second upper 603 prior when said resting area is submersed underwater. The first lower 602 being rearward of the second upper 603 prior allows a user to be seated on said first lower 602, facing outward away from the side of the boat. The second upper prior 603 would be positioned in front of the user in this seated position, serving as an arm rest. The length may be extendable. Said convertible water submersed resting area 507 may swivel upward and downward at a pivot connection at the edge of the deck surface of the boat. This allows said convertible water submersed resting area 507 to be repositioned out of water and above deck, serving the same further function as an above deck bar and resting area. In this instance, the second upper 603 prior horizontal platform would serve as the seating area and the first lower 602 horizontal platform would serve as the arm resting area, positioned in front of the user facing forward away from the boat's side surface. This device, in lowered and submersed position, cannot be used as a water ladder since the second upper 603 rung platform is further away from the deck than the first lower 602 platform. To attempt such use would be impractical and hazardous.

In the upright position, the convertible water submersed resting area 507 is locked into place at its hinge. Said lock may be operated automatically or manually. The device 507, in its above deck position, may dually serve as a guard rail. Said convertible water submersed resting area 507 may be a detachable and portable in nature or else permanently fixed in place on the deck of a watercraft. This particular fixture device 507 is useful on the deck of a boat by providing convertible resting and seating for above and below water surface use. Automatic navigation disabling means may be wired into the convertible water submersed resting area 507 such that when the locking mechanism is released and the arm rest area is lowered into the water, a trigger may be activated to disable the navigation unit for anchoring and safety purposes. This fixture device 507 itself may be an integrated aspect in the cross over feature and function of the watercraft.

The convertible water submersed resting area 507 may have further additional application to any deck side environment adjacent to a body of water. For example, the purpose and effect of this device 507 provided above may be applied similarly to the side deck of a pool or the side of a pier or wharf, etc. The broader concept of this device 507 is to provide convertible cross over effect along the ledge of a deck adjacent to a body of water for dual above ground and below water recreational effect.

Having fully described at least one embodiment of the present invention, other equivalent or alternative methods according to the present invention will be apparent to those skilled in the art. The invention has been described by way of summary, detailed description and illustration. The specific embodiments disclosed in the above drawings are not intended to be limiting. Implementations of the present invention with various different configurations are contemplated as within the scope of the present invention. The invention is thus to cover all modifications, equivalents, and alternatives falling within the spirit and scope of the following claims.

I claim:

1. A cross-over modular watercraft device comprising a plurality of individually navigable watercraft units wherein two or more individually navigable watercraft units are detachably interconnectable to form a cross-over modular watercraft device, each individually navigable watercraft unit is independently navigable, comprising a navigational unit, a deck, a hull, and surrounding sides, each said navigational unit comprising a steering means, a propulsion means, and a disabling or enabling means, each individually navigable watercraft unit having an interlocking mechanism along at least one side wherein an individually navigable water craft unit is detachably connectable to another individually navigable water craft unit by their respective interlocking mechanism and between their each respective hull, deck and navigational unit, to form a cross-over modular watercraft device with a unified hull, a unified deck, a unified surrounding sides and a unified navigational unit, said unified navigational unit of said cross-over modular watercraft device comprising an interconnection of navigational units of each respective individually navigational watercraft device by mechanical, electrical, electronic means or any combinations thereof whereby said interconnection of navigational units is tandemly controlled.

2. A cross-over modular watercraft device of claim 1 wherein each said individually navigable watercraft unit comprising a pontoon style watercraft.

3. A cross-over modular watercraft device of claim 1 comprising two or more individually navigable watercraft units detachably interconnected.

4. Each individually navigable watercraft unit of claim 1, wherein said navigational unit is positioned at one side of said deck defining an abutting side, two or more individually navigable watercraft units interconnectable to each other at their respective abutting sides by their respective deck, hull and navigational unit.

5. Each individually navigable watercraft unit of claim 1, wherein said navigational unit and above deck furnishing are positioned at one side of said deck defining an abutting side, two or more individually navigable watercraft units interconnectable to each other at their respective abutting sides by their respective deck, hull, navigational unit and above deck furnishing.

6. Said deck of each said individually navigable watercraft unit of claim 1 having one or more connection means positioned at preconfigured locations to detachably receive and connect fixture and furnishing.

7. The maximum speed of propulsion of said cross-over modular watercraft device of claim 1 being slower than its respective individually navigable watercraft units.

8. Said unified navigational unit of said cross-over modular watercraft device of claim 1 being tandemly controllable by a designated navigational unit among its said two or more interconnected navigational units.

9. Said unified navigational unit of said cross-over modular watercraft device of claim 1 being tandemly controllable by manual, mechanical, electronic, pneumatic means or combinations thereof.

10. A cross-over modular watercraft device comprising two or more individually navigable watercraft units wherein each individually navigable watercraft unit is independently navigable, each individually navigable watercraft unit comprising a navigational unit, a deck, a hull, above deck furnishing, and surrounding sides, each said navigational unit comprising a steering means, a propulsion means, and a disabling or enabling means, said navigational unit and above deck furnishing positioned at one side of each said individually navigable watercraft unit defining the abutting side of each said individually navigable watercraft unit, wherein two or more individually navigable watercraft units interconnecting at their respective deck, hull and navigational unit along their abutting sides to form said cross-over modular watercraft device, each said navigational unit of said cross-over modular watercraft device interconnecting by a mechanical, electrical, electronic means or combinations thereof, said cross-over modular watercraft device tandemly controlled by its respective interconnected navigational units.

* * * * *